US005429186A

United States Patent [19]

Kurz et al.

[11] Patent Number: 5,429,186

[45] Date of Patent: Jul. 4, 1995

[54] OPEN HOT-WATER HEATER

[75] Inventors: Rolf Kurz; Reinhold Elflein, both of Bad Neustadt/Saale, Germany

[73] Assignee: Forbach GmbH, Bad Neustadt/Saale, Germany

[21] Appl. No.: 102,227

[22] Filed: Aug. 5, 1993

[30] Foreign Application Priority Data

Aug. 5, 1992 [DE] Germany ..... 42 25 827.8

[51] Int. Cl.[6] ..... F28D 7/00

[52] U.S. Cl. ..... 165/157; 122/13.1; 126/374

[58] Field of Search ..... 165/86, 96, 104.22, 165/157; 126/361, 373, 374, 384; 222/335; 122/13.1

[56] References Cited

U.S. PATENT DOCUMENTS

| | | | |
|---|---|---|---|
| 3,435,283 | 3/1969 | Beurtheret | 165/104.22 |
| 3,942,589 | 3/1976 | Opitzer | 165/157 |
| 4,026,675 | 5/1977 | Marsch | 165/157 |
| 4,280,556 | 7/1981 | Cooper | 165/157 |
| 4,311,189 | 1/1982 | Robin | 165/157 |
| 4,357,932 | 11/1982 | Stacy | 165/104.22 |
| 4,862,834 | 9/1989 | Jacobs | 222/335 |

*Primary Examiner*—Ira S. Lazarus

*Assistant Examiner*—Daniel J. O'Connor

*Attorney, Agent, or Firm*—Spencer, Frank & Schneider

[57] ABSTRACT

An open hot-water heater includes a water tank; a hot-water overflow extending from the water tank; a faucet connected to the hot-water overflow; and a cold-water supply arrangement for introducing cold water into the water tank to refill the water tank and to drive hot water therefrom through the hot-water overflow. The cold-water supply arrangement includes a cold-water inlet coupled to the water tank and a cold-water discharge pipe connected to the cold-water inlet and having an outlet opening situated in the tank for introducing cold water into the tank. There is further provided a tank volume varying device and a valve assembly exposed to cold-water pressure prevailing in the cold-water inlet. The cold-water discharge pipe couples the valve assembly to the tank volume varying device for displacing the tank volume varying device by the valve assembly for reducing the tank volume when the valve assembly is moved in response to the cold-water pressure and for displacing the tank volume varying device by the valve assembly for increasing the tank volume when the valve assembly is no longer exposed to the cold-water pressure, whereby a water-free space is obtained above a water level in the tank.

15 Claims, 4 Drawing Sheets

OPEN HOT-WATER HEATER

CROSS REFERENCE TO RELATED APPLICATION

This application claims the priority of German Application No. P 42 25 827.8 filed Aug. 5, 1992, which is incorporated herein by reference.

BACKGROUND OF THE INVENTION

This invention relates to an open hot-water heater which has a hot-water faucet and a water tank provided with a hot-water overflow as well as a device for changing the volume of the water tank. The device for changing the volume of the water tank comprises a lifting valve having a cold-water inlet and a cold-water outlet as well as a lifting device actuated by the lifting valve. When the hot-water faucet is opened, hot water is displaced from the water tank through the hot-water overflow by the inflow of cold water. Upon closing of the hot-water overflow, a water-free space is obtained in the water tank as the valve-lifting device returns into its position of rest.

Thus, it is a characteristic feature of open hot-water heaters, which may also be termed as overflow heaters, that upon dispensing of hot water, cold water flows into the water tank at its lowest zone and the cold water, upon its inflow, delivers to the faucet corresponding hot water quantities from the hot-water overflow which is situated in the highest zone of the water tank. Upon completion of dispensing of water, the water tank is nearly fully filled with water. The water level is situated approximately at the highest location of the hot-water overflow pipe. Upon heating the subsequently introduced cold water, the latter expands and the expanded water leaves the faucet in the form of droplets. The appearance of such dripping water during each heating step is considered as a disadvantageous phenomenon by the consumer and may even prompt a consumer unfamiliar with the causes of the drop formations, to attempt to interfere with the armature of the faucet in an unskilled manner in an endeavor to stop the dripping.

U.S. Pat. No. 4,862,834 discloses an open hot-water heater which is provided with a device for preventing water drip caused by heat expansion. In the hot-water heater disclosed therein the lifting device effecting a change of the volume of the water tank is actuated by a piston valve whose housing is, as a separate component, inserted into the base plate of the water tank. The cold-water inlet for the hot-water tank is divided into two inlet pipe portions by means of the interposed piston valve housing. The two inlet pipe portions are situated externally of the water tank. Connecting the cold-water inlet or cold-water outlet to the piston valve housing as well as joining the water supply to the water tank necessitate complex sealing measures and require a correspondingly time-consuming installation. This leads to an increase in finishing costs, which may render unattractive the price of a mass-produced article of this type.

SUMMARY OF THE INVENTION

It is an object of the invention to provide an open hot-water heater of the above-outlined type which saves space and, above all, is structurally simple. It is a further object to provide a hot-water heater which operates in a highly reliable manner and which may be manufactured and installed economically.

This object and others to become apparent as the specification progresses, are accomplished by the invention, according to which, briefly stated, the open hot-water heater includes a water tank; a hot-water overflow extending from the water tank; a faucet connected to the hot-water overflow; and a cold-water supply arrangement for introducing cold water into the water tank to refill the water tank and to drive hot water therefrom through the hot-water overflow. The cold-water supply arrangement includes a cold-water inlet coupled to the water tank and a cold-water discharge pipe connected to the cold-water inlet and having an outlet opening situated in the tank for introducing cold water into the tank. There is further provided a tank volume varying device and a valve assembly exposed to cold-water pressure prevailing in the cold-water inlet. The cold-water discharge pipe couples the valve assembly to the tank volume varying device for displacing the tank volume varying device by the valve assembly for reducing the tank volume when the valve assembly is moved in response to the cold-water pressure and for displacing the tank volume varying device by the valve assembly for increasing the tank volume when the valve assembly is no longer exposed to the cold-water pressure, whereby a water-free space is obtained above a water level in the tank.

The compact hot-water heater according to the invention has, among others, the further advantage that all water joints are located inside the system, whereby water leakage to the outside is prevented to a large measure.

DESCRIPTION OF THE PREFERRED EMBODIMENTS

Figure 1:
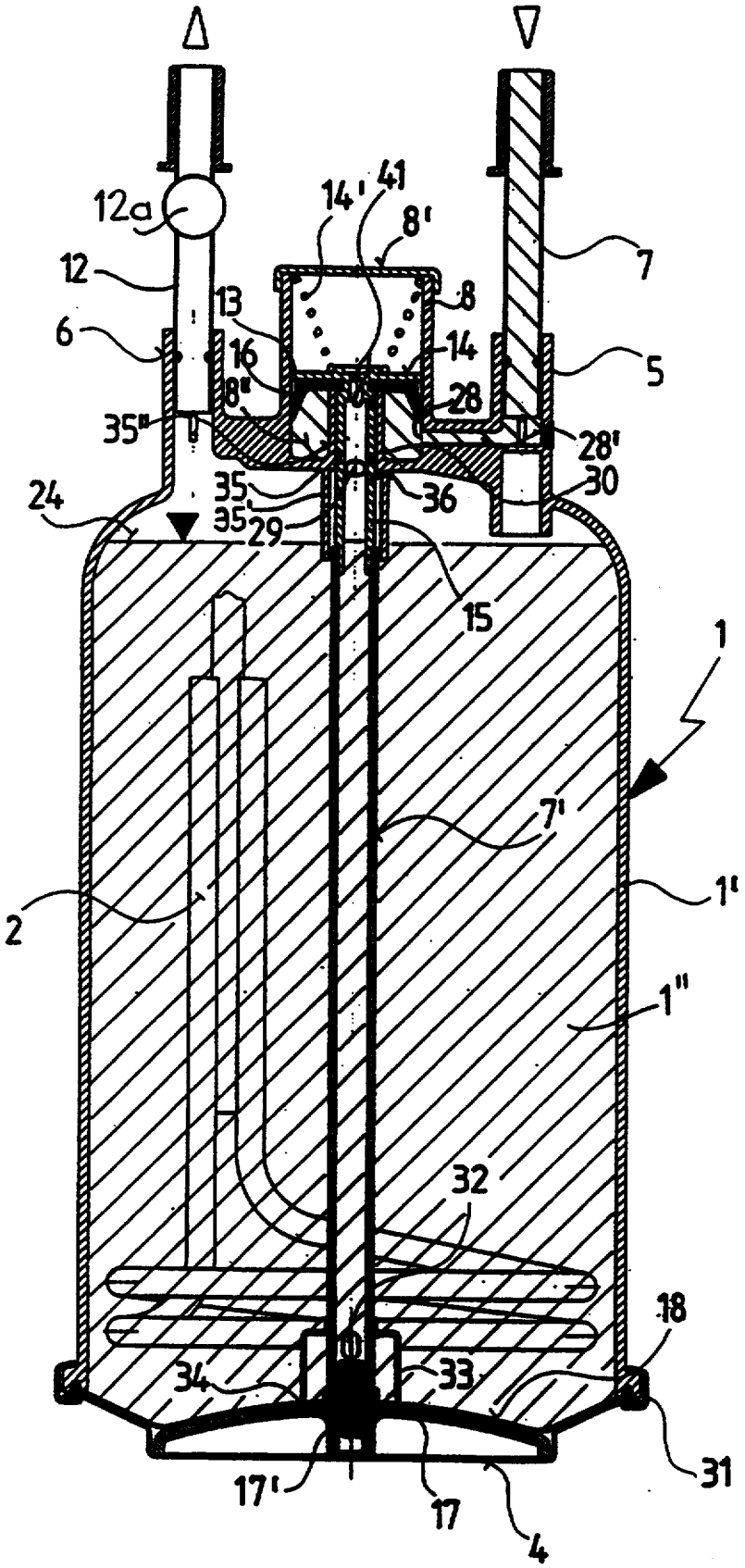
FIG. 1 is an axial sectional view of a first preferred embodiment of the invention for under-the-counter use, illustrated in a position of rest.
Figure 2:
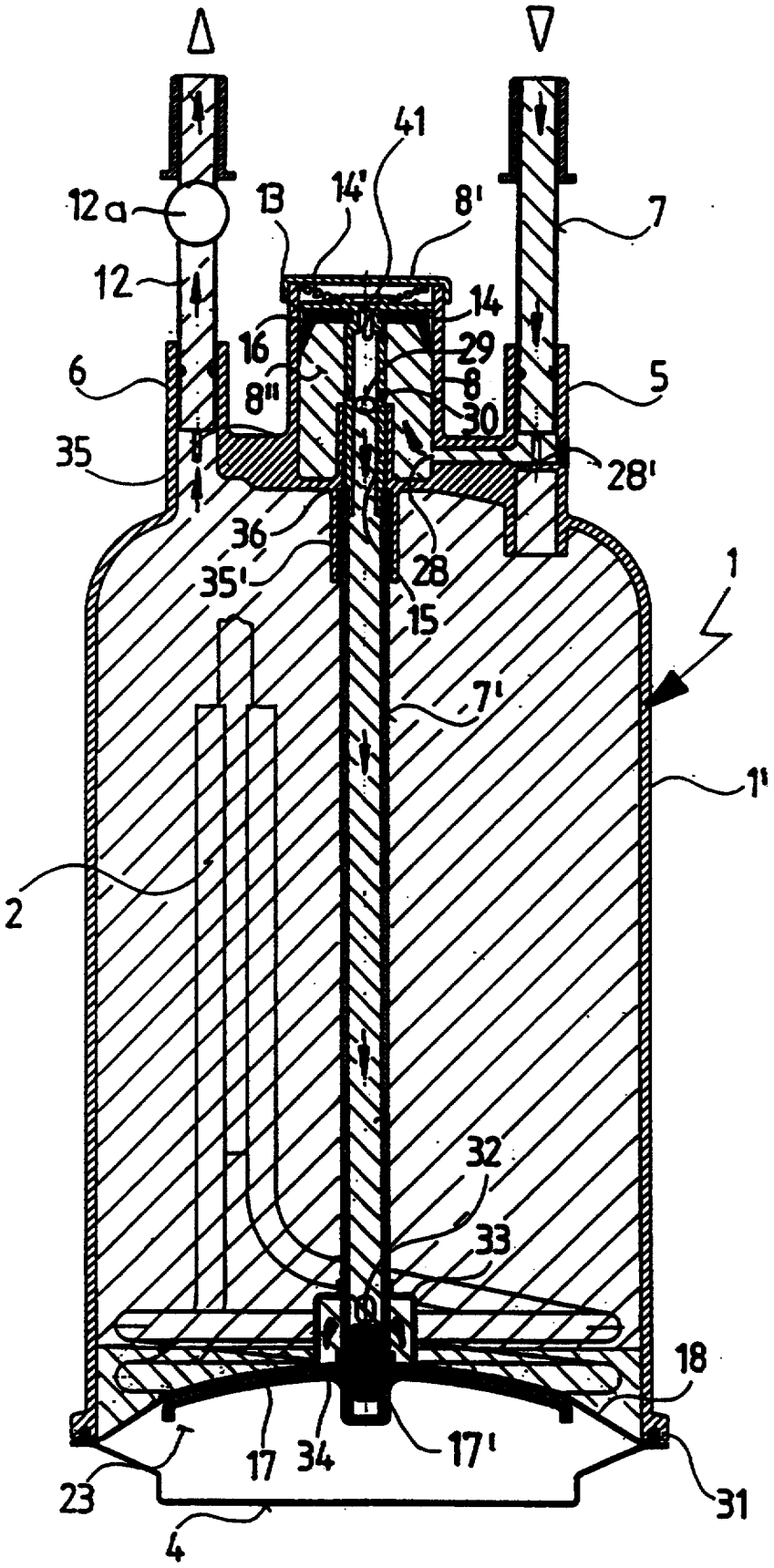
FIG. 2 is a view similar to FIG. 1, illustrating the first preferred embodiment in an operational position.

Turning to FIGS. 1 and 2, there is illustrated therein an open or pressureless hot-water heater having a water tank 1 defining an inner tank space 1" and accommodating an electric heater 2. The hot-water heater is preferably made of a plastic material. The water tank 1 is closed at its lower end by a bottom plate 2. The water tank 1 has a cold-water inlet 7 and a hot-water overflow 12 leading to a faucet 12*a*. Coupling nipples 5 and 6 formed on the top of the tank 1 connect the cold-water inlet 7 and the hot-water overflow 12, respectively, to the tank 1. Further, a cylindrical lifting valve housing 8 is formed on the water tank 1 in the space between the two coupling nipples 5 and 6, accommodating a lifting valve element 13 which is axially slidable therein. The lifting valve housing 8 has a cover 8' which may have a vent (not shown). The lifting valve element 13 comprises a valve plate 14 having a diameter which substantially equals the inner diameter of the cylindrical housing 8 and a hollow piston 15 affixed and extending perpendicularly to the plate 14. Between the valve plate 14 and the cover 8' a compression spring 14' is disposed. In a groove provided circumferentially in the outer face of the piston 15 a sealing body 16 is inserted which engages face-to-face the underside of the valve plate 14 and which seals the inner space of the valve housing 8 in a fluidtight manner. The valve piston chamber 8" underneath the sealing body 16 communicates with the cold-water inlet 7 through an opening 28, a channel 28' and the adjoining coupling nipple 5. The valve housing 8, the water channel 28' and the coupling nipple 5 for the cold-water inlet pipe 7 are all formed on the water tank 1 as components integral therewith. The hollow piston 15 of the lifting valve element 13 is provided with at least one cold-water intake opening 29 which communicates with the valve piston chamber 8". Above the cold-water intake opening 29 there is provided a sealing ring 30 surrounding the piston 15.

With the piston 15 of the valve element 13 a cold-water discharge pipe 7' is connected which passes axially through the water tank 1 and which serves as a lifting rod for the piston valve element 13. The opposite end of the cold-water pipe 7' is coupled by a coupling member 17' with a mushroom-shaped cap 17 supported on the bottom plate 4. A diaphragm-like sealing plate 18 is placed over the mushroom-shaped cap 17. The sealing plate 18, together with the bottom plate 4 which forms the lower closure of the water tank 1 is hermetically tightened to the jacket 1' of the water tank 1. Such a hermetic clamping is effected by means of clamping ring 31 or similar device. The bottom end of the cold-water pipe 7' has a cold-water outlet opening 32 through which cold water is discharged into the tank 1 and which is surrounded by the jacket of a baffle element 33 which, in turn, is provided with a plurality of passages 34. The baffle element 33 is secured to the cold-water pipe 7' and lies on the sealing plate 18 above the mushroom-shaped cap 17. The passages 34 adjoin the sealing plate 18. The piston 15 of the lifting valve element 13 is guided in a sleeve 35 which is formed on the water tank 1 and which extends with a sleeve portion 35" into the lifting valve housing 8 and with a sleeve portion 35' into the inside of the water tank 1. The sleeve portion 35' is of a diameter which is slightly greater than the sleeve portion 35" so that the cold-water discharge pipe 7' inserted on the piston 15 of the lifting valve element 13 may extend into the sleeve portion 35'. An abutment 36 provided in the sleeve portion 35' limits the extent of upward axial displacement of the cold-water discharge pipe 7'.

The hot-water heater of FIGS. 1 and 2 is adapted for an "under-the-counter" installation and use.

In the description which follows, the operation of the above-described hot water heater will be set forth.

Prior to dispensing hot water from the heater 1, the latter is in its non-operating state (position of rest) as shown in FIG. 1.

Referring in particular to FIG. 2, by opening the hot-water faucet 12*a* at which the hot-water overflow 12 terminates, the cold-water supply 7 is also unblocked. This may be achieved, for example, by a non-illustrated valve which controls the cold-water inlet 7 and which is operated in synchronism with the faucet 12*a*. The then-released pressure of the cold water imparts a force in the chamber 8" of the lifting valve housing 8 on the valve plate 14 of the piston 15. As a result, the valve plate 14, the piston 15, the cold-water discharge pipe 7' and the cap 17 are lifted as a unit against the force of the compression spring 14' and/or against the weight of the water. The diaphragm-like sealing plate 18 tightened over the cap 17 is necessarily also lifted and presses or displaces a certain volume-dependent water quantity (approximately 4% of the contents of the water tank) over the hot-water overflow 12 to the faucet 12*a*. As a result, between the diaphragm-like sealing plate 18 and the stationary bottom plate 4 a free space 23 is obtained, whose volume is approximately 4% of the tank space 1" of the water tank 1. When the valve plate 14 and the piston 15 in the lifting valve housing 8 have reached their terminal position, the cold-water intake opening 29 in the hollow piston 15 has cleared the upper edge of the sleeve portion 35" and thus the water supply through the cold-water intake opening 29 in the piston 15 is unblocked to the cold-water discharge pipe 7' and hence to the water tank 1. As long as the hot-water faucet 12*a* is open, hot water is, because of the continuous cold-water supply, driven through the hot-water overflow 12 to the faucet 12*a*.

When the faucet 12*a* is closed and thus the cold-water supply to the water tank 1 is stopped, the valve disc 14, the piston 15, the cold-water pipe 7' and the cap 17 are returned by the expansion of the spring 14' or, as the case may be, the weight of water into the initial position of FIG. 1, at which time a pressure-equalization occurs in the lifting valve housing 8 through the opening 41 of the valve disc 14. The diaphragm-like sealing plate 18 follows positively the return motion of the lifting valve element 13. The water level in the water tank 1 drops in accordance with the previously displaced volume. In this manner, as shown in FIG. 1, in the top part of the water tank 1 there is obtained a water-free space 24 which corresponds to the volume of the previously obtained free space 23. The space 24 may accommodate the expansion-water which is obtained during the heating of the contents of the water tank so that a dripping of water from the faucet 12*a* may not occur.

Figure 3:
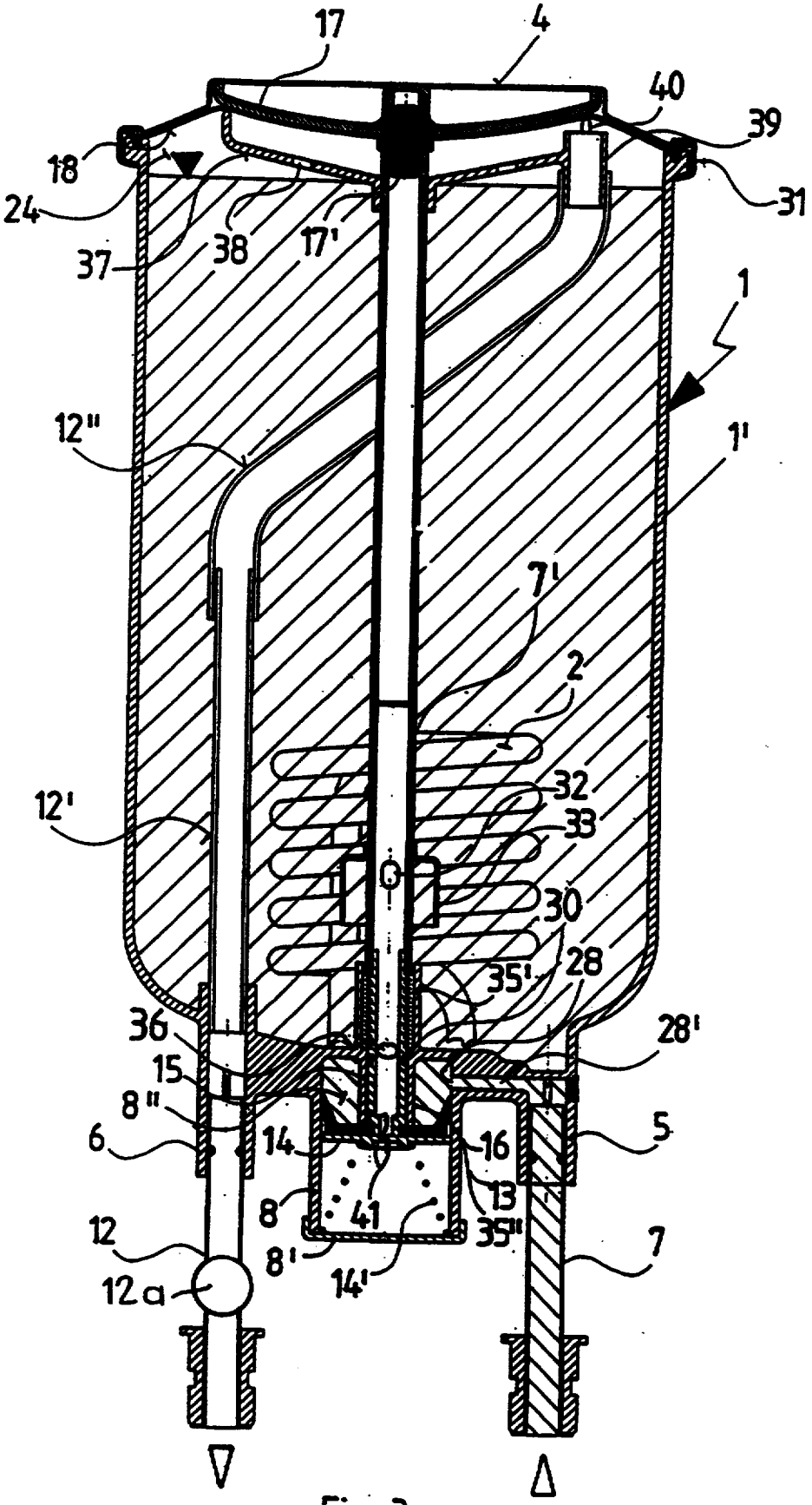
FIG. 3 is an axial sectional view of a second preferred embodiment of the invention, for above-the-counter use, illustrated in a position of rest.
Figure 4:
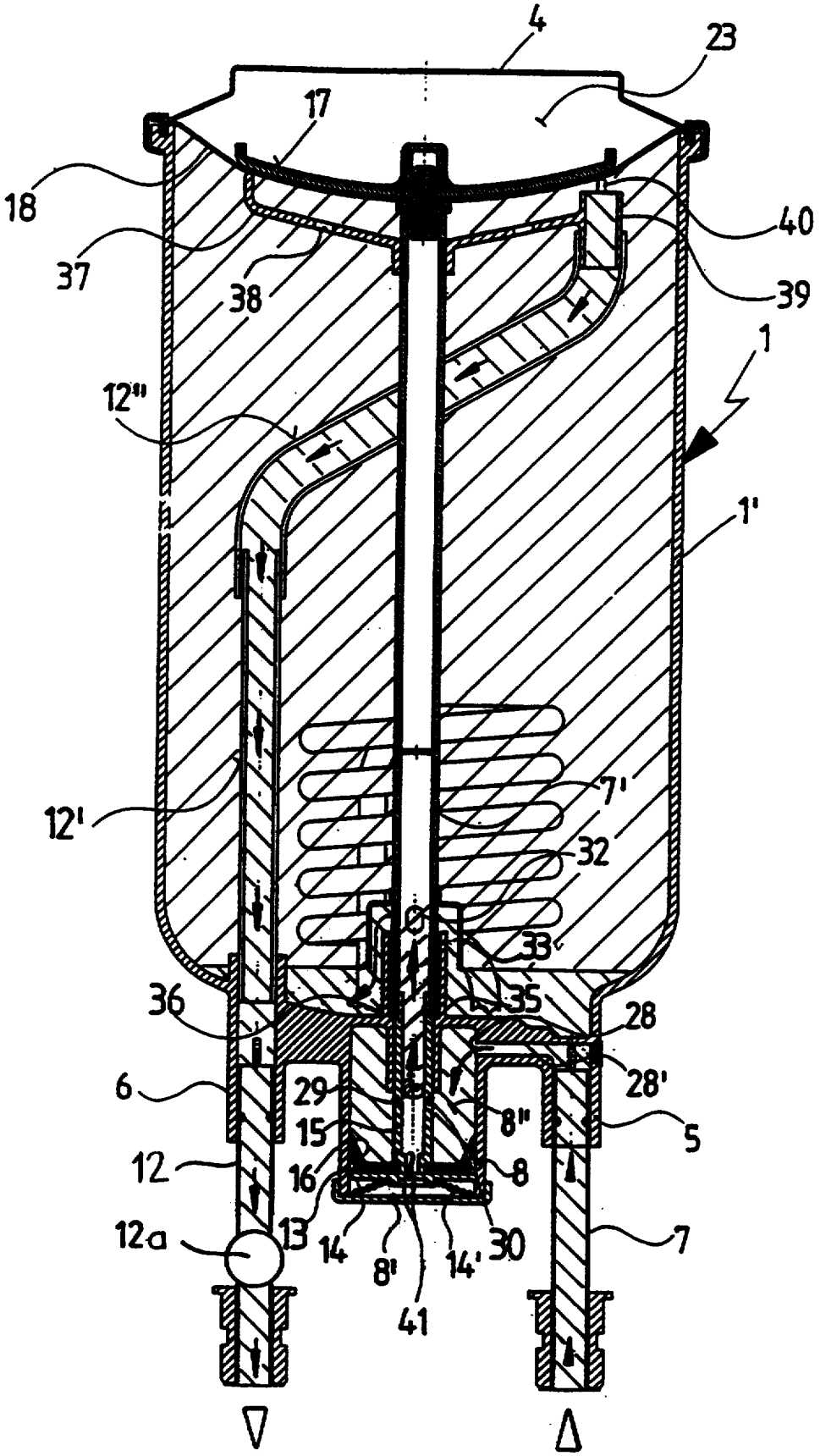
FIG. 4 is a view similar to FIG. 3, illustrating the second preferred embodiment in an operational state.

FIGS. 3 and 4 illustrate an open hot-water heater for above-counter use. The structure and operation of this embodiment is substantially identical to that described in connection with the embodiment illustrated in FIGS. 1 and 2. The hot-water overflow 12 in the embodiment according to FIGS. 3 and 4 has a fixed pipe portion 12' to which there is attached a movable pipe portion 12" formed as a hose. The movable pipe portion 12" is connected to an overflow funnel 37 which is secured to the upper end of the cold-water pipe 7'. The overflow funnel 37 is held against the diaphragm-like sealing plate 18 so that the overflow funnel 37 positively duplicates the displacements of the plate 18. The hot water displaced from the water tank 1 by virtue of the admission of the cold water passes through the openings 38 in the wall of the overflow funnel 37 to a water outlet nipple 39 connected to the movable pipe portion 12" of the hot-water overflow 12. The water outlet nipple 39 is formed on the overflow funnel 37 and has an inlet opening 40.

It will be understood that the above description of the present invention is susceptible to various modifications, changes and adaptations, and the same are intended to be comprehended within the meaning and range of equivalents of the appended claims.

What is claimed is:

1. An open hot-water heater comprising (a) a water tank defining a tank space for accommodating water;

(b) a hot-water overflow extending from said water tank and being in continuous communication with said tank space;

(c) a faucet connected to said hot-water overflow; said faucet having an open position allowing a flow of hot water from said water tank through said hot-water overflow and a closed position blocking the flow of hot water through said hot-water overflow;

(d) cold-water supply means for introducing cold water into said water tank to refill said water tank and drive hot water therefrom through said hot-water overflow; said cold-water supply means including (1) a cold-water inlet coupled to said water tank; and (2) a cold-water discharge pipe connected to said cold-water inlet and having an outlet opening situated in said tank space for introducing cold water through said cold-water discharge pipe into said tank space;

(e) movable means for varying the volume of said tank space; said movable means being displaceable in a direction for reducing said volume and in a direction for increasing said volume;

(f) a valve assembly displaceable in opposite first and second directions; said valve assembly being exposable to a cold-water pressure prevailing in said cold-water inlet; said pressure urging said valve assembly in said first direction; and (g) connecting means for coupling said valve assembly to said movable means for displacing said movable means by said valve assembly in the direction for reducing said volume when the valve assembly is moved in said first direction by said cold-water pressure and for displacing said movable means by said valve assembly in the direction for increasing said volume when said valve assembly is moved in said second direction, whereby a water-free space is obtainable above a water level in said tank space; said connecting means being constituted by said cold-water discharge pipe.

2. The open hot-water heater as defined in claim 1, further comprising a baffle element surrounding said cold-water discharge pipe in a zone of said outlet opening; said baffle element having a plurality of passages for the water.

3. The open hot-water heater as defined in claim 2, wherein said baffle element has a circumferential terminal edge being in engagement with said movable means; said passages being situated in a zone of said circumferential terminal edge.

4. The open hot-water heater as defined in claim 2, wherein said outlet opening comprises a plurality of apertures arranged circumferentially about said cold-water discharge pipe.

5. The open hot-water heater as defined in claim 2, wherein said baffle element is affixed to said cold-water discharge pipe.

6. The open hot-water heater as defined in claim 1, wherein said valve assembly comprises (a) means for defining a valve chamber communicating with said cold-water inlet;

(b) a valve member disposed in said valve chamber and slidingly movable therein in said first and second directions;

(c) a hollow piston affixed to said valve member; said cold-water discharge pipe being attached to said hollow piston; and (d) means defining an aperture in said hollow piston for establishing a hydraulic communication between said valve chamber and said cold-water discharge pipe.

7. The open hot-water heater as defined in claim 6, said valve assembly further comprising a spring urging said valve member for displacement in said second direction.

8. The open hot-water heater as defined in claim 6, further comprising a guide sleeve formed on said water tank; said guide sleeve having a first sleeve portion extending into said valve chamber and a second sleeve portion extending into said tank space.

9. The open hot-water heater as defined in claim 8, wherein said first sleeve portion receives said valve piston to be slidable therein and said second sleeve portion receives said cold-water discharge pipe to be slidable therein; further comprising an abutment provided in said second sleeve portion; said abutment cooperating with an end of said cold-water discharge pipe for limiting a displacement thereof.

10. The open hot-water heater as defined in claim 1, wherein said valve assembly includes a valve housing formed on said water tank as an integral part thereof.

11. The open hot-water heater as defined in claim 10, wherein said hot-water overflow and said cold-water inlet are secured at side-by-side locations to said water tank; said valve housing being situated between said locations.

12. The open hot-water heater as defined in claim 10, further comprising a channel formed in said water tank and maintaining hydraulic communication between said valve chamber and said cold-water inlet.

13. The open hot-water heater as defined in claim 1, further comprising an overflow funnel attached to said cold-water discharge pipe adjacent said movable means and a movable connecting pipe coupling said overflow funnel with said hot-water overflow for maintaining hydraulic communication between said overflow funnel and said hot-water overflow.

14. The open hot-water heater as defined in claim 13, wherein said movable connecting pipe comprises a flexible hose.

15. The open hot-water heater as defined in claim 13, further comprising a water passage provided in said overflow funnel spaced from a location where said movable connecting pipe is coupled to said overflow funnel.

* * * * *